US009159231B2

(12) United States Patent
Noh

(10) Patent No.: US 9,159,231 B2
(45) Date of Patent: Oct. 13, 2015

(54) METHOD FOR TRANSMITTING TRAFFIC INFORMATION USING VEHICLE TO VEHICLE COMMUNICATION

(71) Applicant: Hyundai Motor Company, Seoul (KR)

(72) Inventor: Hahk Rel Noh, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/287,730

(22) Filed: May 27, 2014

(65) Prior Publication Data

US 2015/0170522 A1 Jun. 18, 2015

(30) Foreign Application Priority Data

Dec. 17, 2013 (KR) ..... 10-2013-0157424

(51) Int. Cl.

| | |
|---|---|
| ***G08G 1/0965*** | (2006.01) |
| ***G08G 1/0967*** | (2006.01) |
| *G08G 1/00* | (2006.01) |
| *G08G 1/09* | (2006.01) |

(52) U.S. Cl.

CPC .... *G08G 1/096741* (2013.01); *G08G 1/096791* (2013.01); *G08G 1/09* (2013.01); *G08G 1/22* (2013.01)

(58) Field of Classification Search

CPC ..... G08G 1/00; G08G 1/0104; G08G 1/0112; G08G 1/0967; G08G 1/16

USPC ..... 701/1, 117–119, 301–302; 340/901, 340/903

See application file for complete search history.

(56) References Cited

U.S. PATENT DOCUMENTS

| | | | | |
|---|---|---|---|---|
| 4,706,086 | A * | 11/1987 | Panizza | 340/902 |
| 6,985,089 | B2 * | 1/2006 | Liu et al. | 340/903 |
| 2004/0215373 | A1 | 10/2004 | Won et al. | |
| 2011/0080302 | A1 * | 4/2011 | Muthaiah et al. | 340/903 |
| 2011/0106442 | A1 * | 5/2011 | Desai et al. | 701/208 |
| 2013/0289859 | A1 * | 10/2013 | Kim | 701/117 |

FOREIGN PATENT DOCUMENTS

| | | | |
|---|---|---|---|
| JP | 5260991 | B2 | 8/2013 |
| KR | 2001-0100157 | A | 11/2001 |
| KR | 10-2004-0091833 | A | 11/2004 |
| KR | 10-0515952 | | 9/2005 |

(Continued)

*Primary Examiner* — Thomas Tarcza
*Assistant Examiner* — Tyler J Lee
(74) *Attorney, Agent, or Firm* — Mintz Levin Cohn Ferris Glovsky and Popeo, P.C.; Peter F. Corless

(57) ABSTRACT

A method for transmitting traffic information includes detecting an occurrence event by a first vehicle terminal; generating a traffic information message including information for the occurrence event by the first vehicle terminal; transmitting the traffic information message through vehicle to vehicle (V2V) communication by the first vehicle terminal; receiving and analyzing the traffic information message by the second vehicle terminal which drives in an opposite direction as compared to the first vehicle terminal; retransmitting the traffic information message to a third vehicle terminal located behind the first vehicle terminal depending on an analysis result of the traffic information message by the second vehicle terminal; and outputting an alert based on the event occurrence information of the traffic information message transmitted from the second vehicle terminal to the third vehicle terminal.

17 Claims, 8 Drawing Sheets

(56) References Cited

FOREIGN PATENT DOCUMENTS

| | | | |
|---|---|---|---|
| KR | 10-2006-0064372 | | 6/2006 |
| KR | 10-2007-0106284 | A | 11/2007 |
| KR | 10-2009-0062275 | A | 6/2009 |
| KR | 10-2012-0024230 | | 3/2012 |
| KR | 10-2013-0056732 | A | 5/2013 |

* cited by examiner

METHOD FOR TRANSMITTING TRAFFIC INFORMATION USING VEHICLE TO VEHICLE COMMUNICATION

CROSS-REFERENCE TO RELATED APPLICATION

This application is based on and claims under 35 U.S.C. §119(a) priority from Korean Patent Application No. 10-2013-0157424, filed on Dec. 17, 2013 in the Korean Intellectual Property Office, the disclosure of which is incorporated herein in its entirety by reference.

BACKGROUND (a) Field of the Invention

The present invention relates a method for providing traffic information between vehicles, more particularly, a method for transmitting traffic information using vehicle to vehicle communication, in order to collect and transmit neighboring traffic information through the vehicle to vehicle (V2V) communication.

(b) Description of the Related Art

Using conventional transportation environmental awareness technology, speed information from a proving vehicle such as a taxi or high-pass vehicle, closed circuit television (CCTV) information on a road, a reported accident information, etc. are processed by a traffic center, and the information is transferred to drivers through transport protocol expert group (TPEG), dedicated short range communications (DSRC), a fixed traffic conditions display apparatus (Variable Message Sign: VMS) and the like. However, because conventional technology must pass through the traffic center, the information may not be transmitted in real-time, and thus it may be limited to information such as the average speed of a vehicle or whether a traffic accident has occurred or not. In addition, such information may not be relevant to a receiving vehicle due to a wide range of issues such as lack of accurate position information, and above all, shadow areas may occur for acquisition and delivery of traffic environmental information.

As a vehicle to vehicle (V2V) communication standard, there is IEEE 802.11p WAVE, and it is possible to communicate with vehicle/infra within a distance of several hundred meters. Also, basic safety message (BSM) defined in SAEJ2735 is exchanged between vehicles, and this message includes the movement of the vehicle and event information such as location information of the vehicle, a heading direction, a vehicle speed, an acceleration, a braking, and a directional signal, air bag deployment information, etc.

The vehicle having a vehicle to vehicle communication apparatus can exchange the position information and speed of the vehicle, the vehicle information (braking, airbag deployment, deployment of an anti-lock brake system (ABS)), etc. through the vehicle to vehicle communication with neighboring vehicles within a communication radius. However, conventional vehicle to vehicle communication system technology is focused on an impending collision safety such as forward collision warning (FCW), blind spot warning (BSW), etc. using a relative position of the vehicle and vehicle information within a communication radius of the neighboring 1 hop, and the overall traffic information of the road or information for the position which is more than 1 hop communication range is not being offered. Also, the infra directly collects information for each vehicle through a Vehicle to Infra (V2I) communication, or collects the traffic environment through a camera or a radar mounted on the infra, processes it in a center and then can provide it through a infra to vehicle (I2V) communication again, but the real-time characteristic becomes low and above all, it cannot be offered in the site which a V2I communication is not installed.

SUMMARY

The present invention provides a method utilizing vehicle to vehicle (V2V) communication for collecting and transmitting neighboring traffic information through the V2V communication.

To solve the above problems, the method for transmitting traffic information using a V2V communication according to the present invention comprises steps of detecting an occurrence event by a first vehicle terminal; generating a traffic information message including information for the occurrence event by the first vehicle terminal; transmitting the traffic information message through the V2V communication by the first vehicle terminal; receiving and analyzing the traffic information message by the second vehicle terminal which drives in an opposite direction as compared to the first vehicle terminal; retransmitting the traffic information message to a third vehicle terminal located behind the first vehicle terminal depending on an analysis result of the traffic information message by the second vehicle terminal; and outputting an alert based on the event occurrence information of the traffic information message transmitted from the second vehicle terminal to the third vehicle terminal.

Also, the step of detecting an occurrence event comprises steps of collecting vehicle state information by the first vehicle terminal, and determining whether an event is occurred based on the vehicle state information collected by the first vehicle terminal.

Also, the vehicle state information includes a deceleration, a speed, operation of an anti-lock brake system (ABS) and electronic stability control (ESC), a delta steering angle, a yaw rate, detection of an obstacle by a radar, detection of the obstacle by a camera.

Also, the traffic information message includes event occurrence information and event occurrence vehicle information.

Also, the event occurrence information includes an event occurrence time, an event occurrence position and an event type.

Also, the event occurrence vehicle information includes vehicle identification information and a driving direction.

Also, the collecting and analyzing step by the second vehicle terminal includes receiving the traffic information message by the second vehicle terminal; verifying whether the traffic information message is duplicated or not by the second vehicle terminal; verifying whether previously stored event information which matches the event occurrence information of the traffic information message exists or not, if the traffic information message is not duplicated; and increasing a consistency level for the event occurrence information if previously stored event information which matches the event occurrence information of the traffic information message exists.

Also, the step of receiving the traffic information message by the second vehicle terminal includes verifying whether the traffic information message is information for an opposite direction lane.

Also, the step of verifying whether the traffic information message is duplicated includes comparing vehicle identification information, an event occurrence time, and an event occurrence position with previously stored event information.

Also, in the step of verifying whether the traffic information message is duplicated, if the traffic information message is duplicated, the traffic information message is deleted.

Also, in the step of verifying whether previously stored event information which matches the event occurrence information exists, if the previously stored event information which matches the event occurrence information does not exist, the traffic information message is stored.

Also, the step of retransmitting the traffic information message by the second vehicle terminal includes transmitting the traffic information message whenever the second vehicle terminal moves a certain distance.

Also, the second vehicle terminal performs retransmission of the traffic information message within an effective distance from the event occurrence position.

Also, the second vehicle terminal performs retransmission of the traffic information message within an effective time from the event occurrence time.

Also, the step of outputting an alert comprises verifying whether the event occurrence information of the traffic information message occurred in a driving path, verifying whether the event occurrence information satisfies a driver alert condition, and determining an output of an alert depending on whether the event occurrence information satisfies a driver alert condition.

Also, the step of verifying whether the event occurrence information satisfies a driver alert condition includes verifying whether a vehicle speed exceeds a threshold speed and whether a relative distance to the event occurrence position is less than a threshold distance, and whether a consistency level exceeds a threshold level.

Also, the step of determining an output of an alert includes displaying an event occurrence position and an event type on a map if the event occurrence information satisfies an alert condition.

As described above, the present invention detects the event that occurred in a vehicle and transmits to other vehicles through a V2V communication, and collects and analyzes the event information generated in the vehicle of the opposite direction lane, transmits the generated event information to the rear vehicle and thus can provides the driver of the rear vehicle with the front traffic situation.

Also, since the present invention provides the driver with the information for the front traffic situation in real time using the V2V communication without any V2I communication facilities, traffic accidents can be prevented and traffic flow can be improved.

Also, since the present invention does not require separate facilities such as V2I communication facilities, the cost of building can be reduced and the traffic information service area can be enlarged.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE INVENTION

Hereinafter, embodiments of the present invention will be described in detail with reference to the accompanying drawings.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 1:
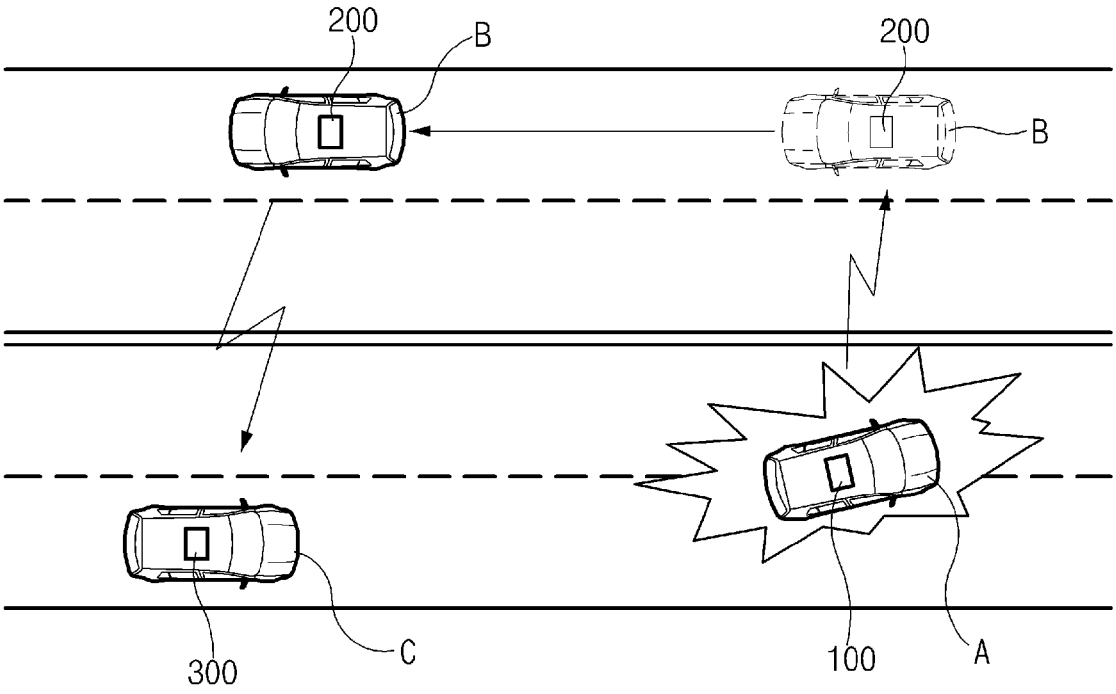
FIG. 1 is a conceptual diagram showing a traffic information delivery process using V2V communication according to the present invention.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN). FIG. 1 is a conceptual diagram showing a traffic information delivery process using V2V communication according to the present invention.

As shown in FIG. 1, a first vehicle A and a third vehicle C are driving in one direction, and a second vehicle B is driving in the opposite direction to the first vehicle A and the third vehicle C. In this state, if an unexpected situation (for example, quick braking) occurs, information for the unexpected situation is transmitted through V2V communication, and the transmission process will be described. Here, the V2V communication between the first vehicle A through the third vehicle C is performed by the first through the third vehicle terminals 100 through 300 mounted on each vehicle. In particular, each of the first, second, and third vehicles A, B, and C has a respective first, second, and third vehicle terminal 100, 200, and 300 associated with the vehicle. As used herein, the term "V2V communication" refers generally to vehicle-to-vehicle communication that occurs between different vehicles, and as provided herein, may refer to a communication between specific vehicles, e.g., a V2V communication between vehicle A and vehicle B.

The first through the third vehicle terminals 100 through 300 comprise a communication module (not shown) for performing V2V communication. Also, the first through the third vehicle terminals 100 through 300 collect the vehicle state information from electronic control units (ECUs) and sensors through a controller area network (CAN) communication. Here, the vehicle state information includes deceleration, speed, operation/deployment of an anti-lock brake system (ABS) and electronic stability control (ESC), the delta steering angle and yaw rate, detection of an obstacle (falling object) by radar or an image sensor and the like. For example, the term "operation" of an ABS system refers to whether or not the ABS system of the vehicle is deployed.

The first vehicle terminal 100 detects an event (unexpected situation) generated in the first vehicle A based on the vehicle state information collected from electronic control units and sensors. For example, the first vehicle terminal 100 recognizes as the occurrence of a quick brake event if the deceleration is lower than a threshold value.

The first vehicle terminal 100 generates the traffic information message which includes information for the event that has occurred. At this time, the traffic information message includes the occurred event information and information for the vehicle which the event is occurred. Here, the occurred event information includes the position (global positioning system value) and the time of the occurred event, and the type of the occurred event, etc. and the information for the event occurred vehicle includes a vehicle identification information and the driving direction (heading), etc.

If the traffic information message is generated, the first vehicle terminal 100 transmits the message to another vehicle, e.g., the second vehicle terminal 200, through the V2V communication.

The second vehicle terminal 200 receives the traffic information message transmitted from the first vehicle terminal 100 and temporally stores it to a memory. At this time, the second vehicle terminal 200 verifies whether the received message is the traffic information for the opposite direction lane by comparing the driving direction information included in the received traffic information message with its own driving direction.

Also, the second vehicle terminal 200 verifies whether the received traffic information message is a redundant message. At this time, if the received message is a redundant message, the second vehicle terminal 200 deletes the message.

If the received traffic information message is new information, the second vehicle terminal 200 stores it in a memory. And, if the vehicle identification information included in the received traffic information message is different but the event information is same, the second vehicle terminal 200 increases the consistency level for the event information by 1 level. Here, the consistency level is used to evaluate the reliability for the event information, and as the consistency level is higher, the reliability for the event information is improved.

In other words, in the present invention, if the second vehicle terminal 200 receives the same event information transmitted from a plurality of event occurred vehicle terminals, the reliability for the event information is improved.

If the second vehicle terminal 200 moves a threshold distance after receiving the traffic information message, the second vehicle terminal 200 retransmits the received traffic information message. Here, the threshold distance may be a vehicle to vehicle communication possible distance or a predetermined distance, and it is varied according to a straight line or a curve line. In this embodiment, for example, retransmitting the traffic information message after moving more than the threshold distance, is explained, but the invention is not limited to the example and may be implemented to retransmit the traffic information message after moving for more than a certain period of time.

The second vehicle terminal 200 periodically retransmits the traffic information message within the effective distance or effective time. At this time, the second vehicle terminal 200 transmits the traffic information message including the consistency level for the event information.

The third vehicle terminal 300 receives traffic information message retransmitted from the second vehicle terminal 200 of the relay vehicle B. The third vehicle terminal 300 verifies whether the driver alert condition is satisfied, based on the event information included in the traffic information message.

In other words, the third vehicle terminal 300 verifies whether the received traffic information message is the event information generated in the driving path. At this time, a third vehicle terminal 300 verifies it by comparing the driving direction information of the received traffic information message with its own driving direction information. And, if the event information in the received traffic information message is the event occurred in its own driving path, the third vehicle terminal 300 verifies whether its own vehicle speed exceeds the threshold speed and whether the relative distance to the event occurrence position is less than the threshold distance, and whether the consistency level exceeds the threshold level.

If the event alert condition of the event information is satisfied, the third vehicle terminal 300 alerts the event information to the driver. For example, if the relative distance to the position of the event occurrence of the own vehicle C is less than the threshold distance, the third vehicle terminal 300 displays the event occurrence position and the event type on the navigation map and outputs voice guidance.

Figure 2:
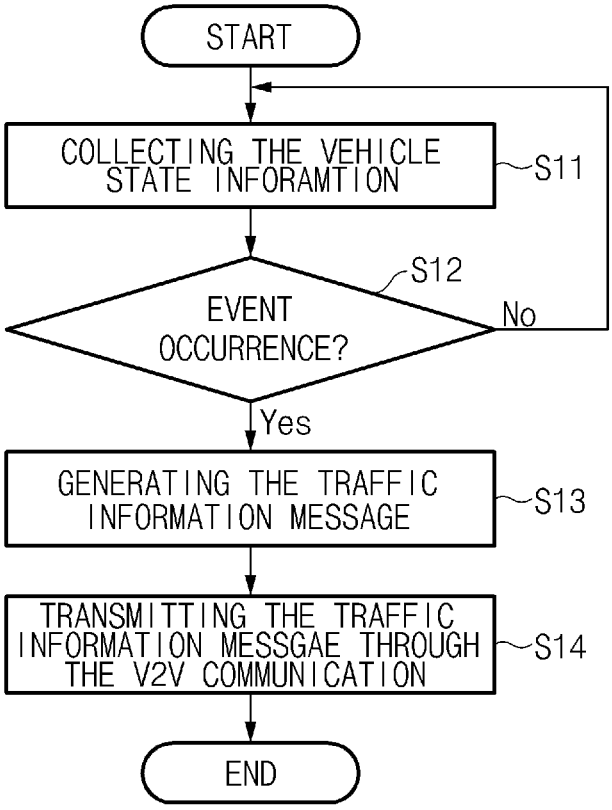
FIG. 2 is a flow chart showing an operation process of the vehicle in which an event occurs according to the present invention.

FIG. 2 is a flow chart showing an operation process of the vehicle in which an event occurs according to the present invention.

As shown in FIG. 2, the first vehicle terminal 100 collects the state information for its own vehicle (S11). The first vehicle terminal 100 collects the vehicle state information such as a deceleration, a speed, operation of ABS and ESC, a steering angle, a yaw rate from electronic control units and sensors, or detecting or not of the obstacle by a radar or a camera, etc.

The first vehicle terminal 100 verifies whether an event occurs, based on the collected vehicle state information (S12). For example, the first vehicle terminal 100 recognizes as a congestion event if its own vehicle speed is less than the threshold speed.

If the event occurrence is detected in the step (S12), the first vehicle terminal 100 generates the traffic information message (S13). Here, the traffic information message includes event occurrence information and event occurrence vehicle information. The event occurrence includes the event occurrence time, the event location, the event types and the like, and the event occurrence vehicle information includes the vehicle identification information and the driving direction and the like. The event type includes a quick brake, a sliding, congestion, a rapid lane change, the presence of obstacle and the like.

If the traffic information message is generated, the first vehicle terminal 100 transmits the generated traffic information message over the wireless communication (S14). Here, the radio communication is the V2V communication.

Figure 3:
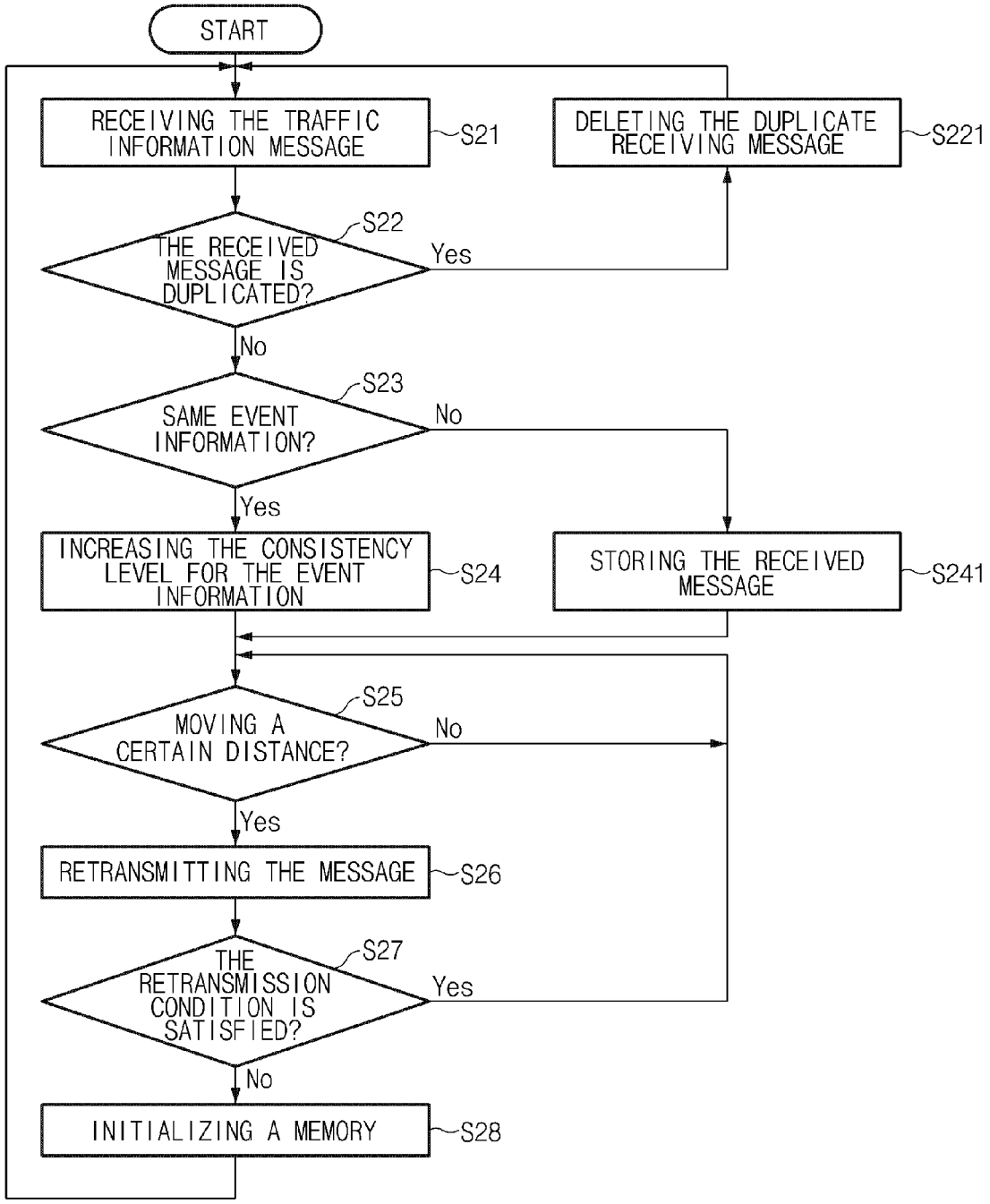
FIG. 3 is a flow chart showing an operation process of a relay vehicle terminal according to the present invention.

FIG. 3 is a flow chart showing an operation process of a relay vehicle terminal according to the present invention. Referring to FIG. 3, the second vehicle terminal 200 receives the traffic information message through the V2V communication (S21). At this time, the second vehicle terminal 200 stores the traffic information message in the temporary memory in the received order. And, the second vehicle terminal 200 processes the traffic information in the received order.

The second vehicle terminal 200 verifies whether the received traffic information message is duplicated (S22). The second vehicle terminal 200 verifies whether the previously stored traffic information message, which the vehicle identification information (event identification information) and event occurrence time included in the received traffic information message match, exists or not. In other words, the second vehicle terminal 200 verifies whether the traffic information, which the event occurrence vehicle identification information and the event occurrence information match, is in memory or not.

If the received traffic information is a duplicate message, the second vehicle terminal 200 deletes the message (S221). The second vehicle terminal 200 deletes the received traffic information message if the traffic information, which the event occurrence vehicle identification information and the occurrence event information match, is searched in the memory.

On the other hand, if the received traffic information is not a duplicate message, the second vehicle terminal 200 verifies whether the event information included in the received traffic information message is the same or not (S23). That is, the second vehicle terminal 200 verifies whether the event occurrence vehicle information is different but the traffic information which the event information occurred in the vehicle is the same exists in the memory.

If the event information, which the event information included in the received traffic information message match, exists, the second vehicle terminal 200 increases the consistency level for the event information by 1 level (S24).

Meanwhile, if the event information, which the event information included in the traffic information message received in the step (S23) match, does not exist, the second vehicle terminal 200 stores the received traffic information message in the memory (S241). In other words, if the same event information is not retrieved from the memory, the second vehicle terminal 200 recognizes as a new message (new event information) and stores it in the memory.

Then, the second vehicle terminal 200 verifies whether the vehicle has moved a certain distance or not (S25).

The second vehicle terminal 200, when its own vehicle has moved a certain distance, retransmits the received traffic information message (S26). In the present embodiment, the example, retransmitting the received traffic information alert message whenever it moves a certain distance, is explained, but the invention is not limited to the example and may be implemented to retransmit it in each period of time.

And, the second vehicle terminal 200 verifies whether the retransmission condition is satisfied (S27). Here, the retransmission condition may be one of whether the retransmission limit number is exceeded, within the effective distance from the position and within the effective time from the occurrence time.

If the additional retransmission is impossible, the second vehicle terminal 200 initializes the memory (S28). If its own vehicle does not satisfy the retransmission condition, the second vehicle terminal 200 stops retransmitting the received traffic information message and deletes information related to previously received traffic information message stored in the memory.

Meanwhile, if the additional retransmissions are possible in the step 27, the step S25 is returned to retransmit the received traffic information message after moving a certain distance.

Figure 4:
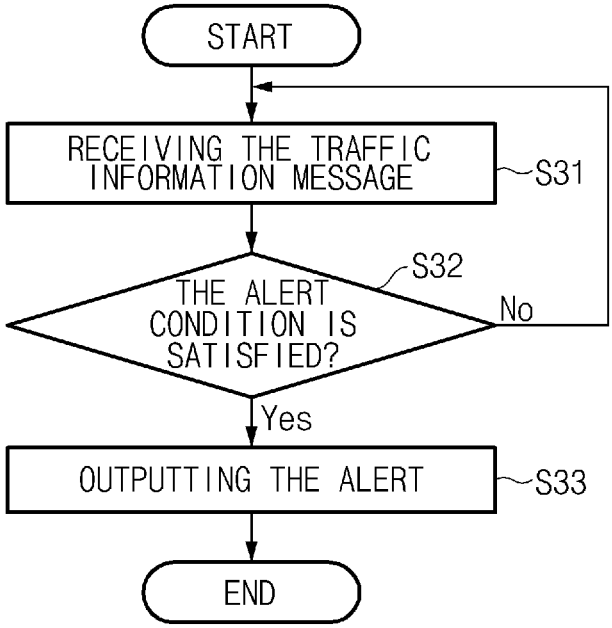
FIG. 4 is a flow chart showing an operation process of a rear vehicle terminal according to the present invention.

FIG. 4 is a flow chart showing an operation process of a rear vehicle terminal according to the present invention.

The third vehicle terminal 300 receives the traffic information message through the V2V communication (S31). At this time, a third vehicle terminal 300 verifies whether the event occurrence information of the received traffic information message is information for the event that has occurred in the driving path by using the driving direction information included in the received traffic information message.

The third vehicle terminal 300 verifies the driver alert condition based on the event occurrence information included in the received traffic information message (S32). For example, the third vehicle terminal 300 verifies whether the event occurrence location included in the received traffic information message is within a threshold distance from its vehicle.

The third vehicle terminal 300 outputs an alert message based on the event occurrence information (S33). At this time, a third vehicle terminal 300 visualizes or auralizes information about the event occurrence information and outputs it.

Figure 5:
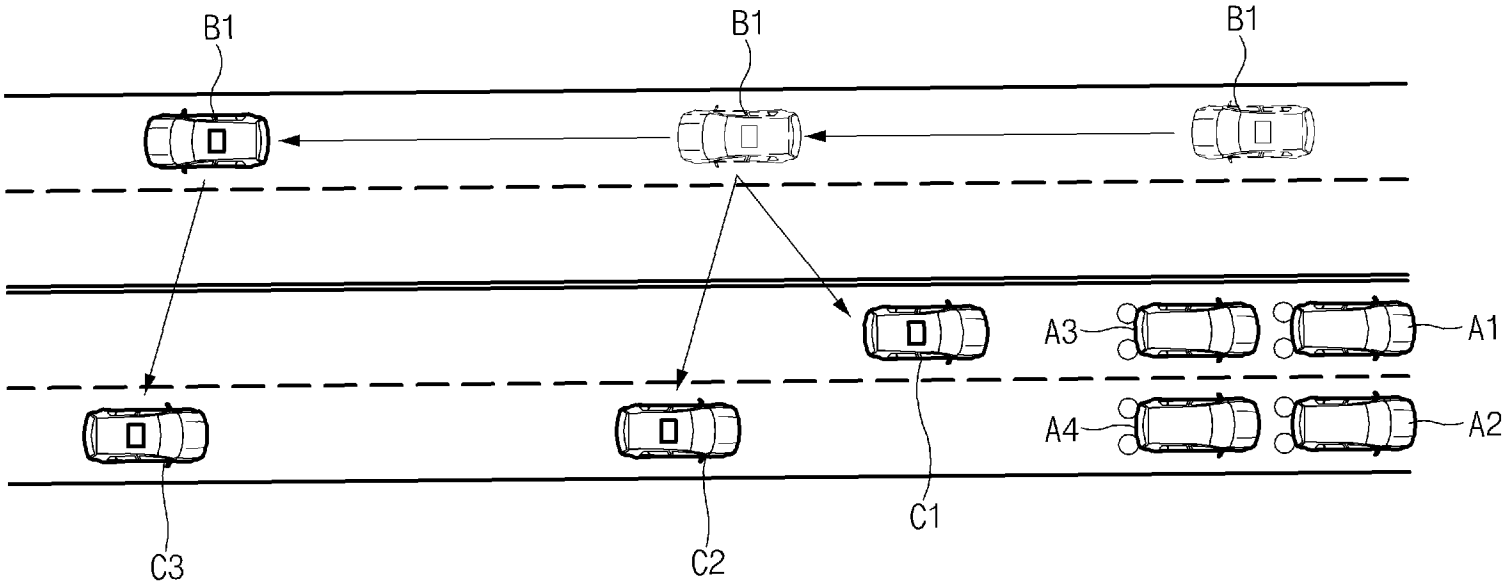
FIG. 5 is a flow chart showing a transmission process of information in which emergency congestion is generated according to the present invention.

FIG. 5 is a flow chart showing a transmission process of information in which emergency congestion is generated according to the present invention.

Referring to FIG. 5, the vehicle terminals of the vehicles A1 to A4 recognize as the occurrence of an emergency congestion event if the vehicle speed is less than the threshold speed. Accordingly, the vehicle terminals of the vehicles A1 to A4 generate the traffic information message notifying the occurrence of the emergency congestion event and transmit it.

The vehicle terminal of the vehicle B1 receives the traffic information message transmitted from the vehicle terminals of the vehicles A1 to A4. Here, since the event information included in the received traffic information messages is the same, the vehicle terminal of the vehicle B1 sets the consistency level as 4.

The vehicle terminal of the vehicle B1 retransmits the received traffic information after moving a certain distance. Accordingly, the rear vehicles C1 and C2 of the vehicles A1 to A4 output an alert based on the traffic information message relayed through the vehicle terminal of the vehicle B1.

Hereafter, the vehicle terminal of the vehicle B1 additionally retransmits the received traffic information message to the vehicle C3.

Figure 6:
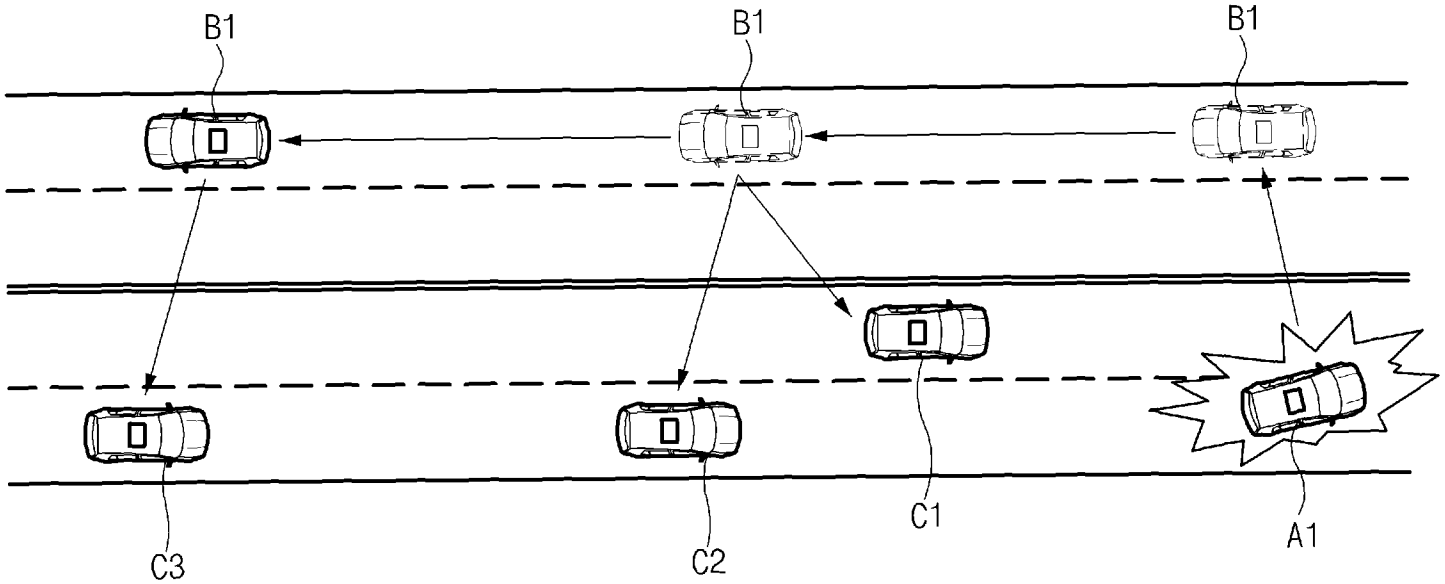
FIG. 6 is an exemplary diagram showing a transmission process of information in which sliding of a vehicle is generated according to the present invention.

FIG. 6 is an exemplary diagram showing a transmission process of information in which sliding of a vehicle is generated according the present invention.

If the vehicle terminal of the vehicle A1 detects the operation of ABS, the vehicle terminal of the vehicle A1 determines that a vehicle slipping event is occurred. Accordingly, the vehicle terminal of the vehicle A1 generates the traffic information message including information for the occurred event and transmits it.

The vehicle terminal of the vehicle B1 receives the traffic information message through the V2V communication with the vehicle terminal of the vehicle A1.

If received traffic information message is not duplicated, the vehicle terminal of the vehicle B1 transmits the message to the rear vehicles C1, C2 and C3 of vehicle A1 whenever it moves a certain distance. The vehicle terminals of the vehicles C1, C2 and C3 output an alert based on the event information of the received traffic information message, so that a driver can avoid driving in the icing region in which the vehicle has slipped.

Figure 7:
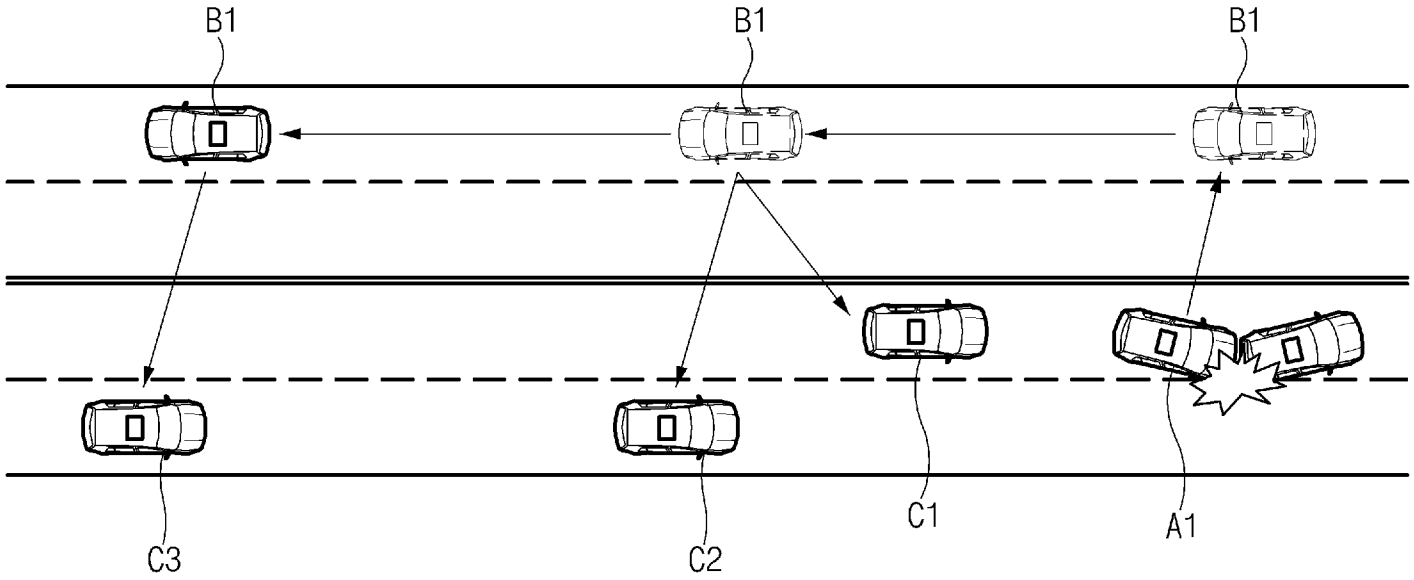
FIG. 7 is an exemplary diagram showing a transmission process of information in which a vehicle accident is generated according to the present invention.

FIG. 7 is an exemplary diagram showing a transmission process of information in which a vehicle accident is generated according the present invention.

If the airbag of the vehicle A1 is activated due to the collision with the preceding vehicle, the vehicle terminal of the vehicle A1 detects the airbag activation and based on the detected vehicle state information, determines that a car accident event is occurred.

Subsequently, the vehicle terminal of the vehicle A1 generates the traffic information message using the information for the occurred car accident and transmits it.

If the traffic information message including the car accident event information is received, the vehicle terminal of the vehicle B1 retransmits the received traffic information message whenever it moves a certain distance.

The vehicles C1 and C2 output the front traffic information relayed by the vehicle B1 to the driver visually and/or acoustically.

Figure 8:
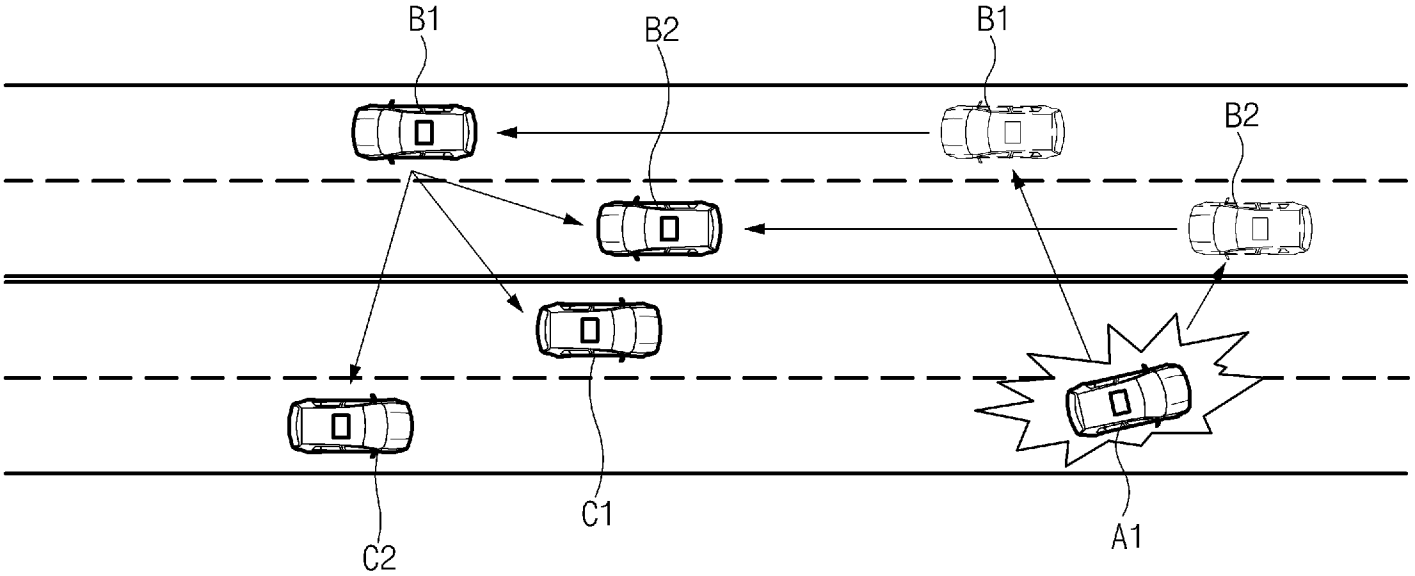
FIG. 8 is an exemplary diagram showing an avoidance process of a redundant transmission according to the present invention.

FIG. 8 is an exemplary diagram showing an avoidance process of a redundant transmission according to the present invention.

The vehicle terminal of the vehicle A1 detects the unexpected situation, and generates the traffic information message by using information for the unexpected situation and transmits it.

The vehicle terminals of the vehicles B1 and B2 receive the traffic information message transmitted from the vehicle terminal of the vehicle A1.

Next, the vehicle terminal of the vehicle B1 retransmits the received traffic information message after moving a certain distance. The traffic information message retransmitted by the vehicle terminal of the vehicle B1 is received by the vehicle terminals of the rear vehicles C1 and C2 of the vehicle A1 and the rear vehicle B2 of the vehicle B1.

The vehicle terminal of the vehicle B2 verifies whether the traffic information message provided by the vehicle terminal of the vehicle B2 is duplicated or not. If the received traffic information message is same as the traffic information message previously received from the vehicle terminal of the vehicle A1, the vehicle terminal of the vehicle B2 deletes the traffic information message. Accordingly, the vehicle terminal of the vehicle B2 prevent from transmitting the same traffic information redundantly.

While the present invention has been described with respect to the specific embodiments, it will be apparent to those skilled in the art that various changes and modifications may be made without departing from the spirit and scope of the invention as defined in the following claims.

What is claimed is:

1. A method for transmitting traffic information using a vehicle to vehicle (V2V) communication, comprising steps of:

detecting an occurrence event by a first vehicle terminal;

generating a traffic information message including information for the occurrence event by the first vehicle terminal;

transmitting the traffic information message through the V2V communication by the first vehicle terminal;

receiving and analyzing the traffic information message by a second vehicle terminal which drives in an opposite direction as compared to the first vehicle terminal;

increasing a consistency level for the event occurrence information when previously stored event information matching the event occurrence information of the received traffic information message exist;

retransmitting the traffic information message to a third vehicle terminal located behind the first vehicle terminal depending on an analysis result of the traffic information message by the second vehicle terminal; and outputting an alert based on the consistency level for the event occurrence information of the traffic information message transmitted from the second vehicle terminal to the third vehicle terminal.

2. A method for transmitting traffic information of claim 1, wherein the step of detecting the occurrence event comprises steps of:

collecting a vehicle state information by the first vehicle terminal; and determining whether the occurrence event has occurred based on the vehicle state information collected by the first vehicle terminal.

3. A method for transmitting traffic information of claim 2, wherein the vehicle state information includes a deceleration, a speed, deployment of an anti-lock brake system (ABS) and electronic stability control (ESC), a delta steering angle, a yaw rate, detection of an obstacle by a radar, and detection of the obstacle by a camera.

4. A method for transmitting traffic information of claim 1, wherein the traffic information message includes event occurrence information and event occurrence vehicle information.

5. A method for transmitting traffic information of claim 4, wherein the event occurrence information includes an event occurrence time, an event occurrence position and an event type.

6. A method for transmitting traffic information of claim 4, wherein the event occurrence vehicle information includes vehicle identification information and a driving direction.

7. A method for transmitting traffic information of claim 1, wherein the receiving and analyzing step by the second vehicle terminal includes:

receiving the traffic information message by the second vehicle terminal;

verifying whether the traffic information message is duplicated or not by the second vehicle terminal; and verifying whether previously stored event information which matches the event occurrence information of the traffic information message exists or not, if the traffic information message is not duplicated.

8. A method for transmitting traffic information of claim 7, wherein the step of receiving the traffic information message by the second vehicle terminal includes verifying whether the traffic information message is information for a lane in the opposite direction.

9. A method for transmitting traffic information of claim 7, wherein the step of verifying whether the traffic information message is duplicated includes comparing vehicle identification information, an event occurrence time, and an event occurrence position with previously stored event information.

10. A method for transmitting traffic information of claim 7, wherein in the step of verifying whether the traffic information message is duplicated, if the traffic information message is duplicated, the traffic information message is deleted.

11. A method for transmitting traffic information of claim 7, wherein in the step of verifying whether previously stored event information which matches the event occurrence information exists, if the previously stored event information which matches the event occurrence information does not exist, the traffic information message is stored.

12. A method for transmitting traffic information of claim 1, wherein the step of retransmitting the traffic information message by the second vehicle terminal includes transmitting the traffic information message whenever the second vehicle terminal moves a certain distance.

13. A method for transmitting traffic information of claim 12, wherein the second vehicle terminal performs retransmission of the traffic information message within an effective distance from the event occurrence position.

14. A method for transmitting traffic information of claim 12, wherein the second vehicle terminal performs retransmission of the traffic information message within an effective time from the event occurrence time.

15. A method for transmitting traffic information of claim 1, wherein the step of outputting the alert further comprises steps of:

verifying whether the event occurrence information of the traffic information message occurred in a driving path;

verifying whether the event occurrence information satisfies a driver alert condition; and determining an output of the alert depending on whether the event occurrence information satisfies the driver alert condition.

16. A method for transmitting traffic information of claim 15, wherein the step of verifying whether the event occurrence information satisfies the driver alert condition includes verifying whether a vehicle speed exceeds a threshold speed and whether a relative distance to the event occurrence position is less than a threshold distance, and whether the consistency level exceeds a threshold level.

17. A method for transmitting traffic information of claim 15, wherein the step of determining an output of the alert displays an event occurrence position and an event type on a map if the event occurrence information satisfies an alert condition.

* * * * *